United States Patent [19]

Odashima

[11] Patent Number: 4,671,362

[45] Date of Patent: Jun. 9, 1987

[54] AUTOMATIC FIRE EXTINGUISHER WITH INFRARED RAY RESPONSIVE TYPE FIRE DETECTOR

[75] Inventor: Takashi Odashima, Mitaka, Japan

[73] Assignee: Tekken Construction Co., Ltd., Japan

[21] Appl. No.: 817,060

[22] Filed: Jan. 8, 1986

[30] Foreign Application Priority Data

Apr. 23, 1985 [GB] United Kingdom ..... 8510356

[51] Int. Cl.[4] ..... A62C 35/02

[52] U.S. Cl. ..... 169/61; 169/26; 250/342; 340/578

[58] Field of Search ..... 169/60, 61, 26; 340/578; 250/342

[56] References Cited

U.S. PATENT DOCUMENTS

| | | | |
|---|---|---|---|
| 2,994,859 | 8/1961 | Klein | 340/578 |
| 3,588,893 | 6/1971 | McCloskey | 169/61 |
| 4,553,031 | 11/1985 | Cholin et al. | 340/578 |

FOREIGN PATENT DOCUMENTS

| | | | |
|---|---|---|---|
| 142099 | 11/1979 | Japan | 340/578 |
| 55-25862 | 7/1980 | Japan | 169/61 |
| 55-33911 | 9/1980 | Japan | 169/61 |
| 56-28544 | 7/1981 | Japan | 169/61 |

*Primary Examiner*—Andres Kashnikow
*Assistant Examiner*—Michael J. Forman
*Attorney, Agent, or Firm*—Leydig, Voit & Mayer

[57] ABSTRACT

An automatic fire extinguisher wherein a fire detector receives infrared rays from started fire flame in detecting area at one of many light receiving elements which corresponds to the ray's incident angle into an assembly of infrared-ray passing filter and condenser lens, variations in detected output of the detector resulting from flaring of the fire flames are discriminated, the detected output higher than a predetermined level controllably drives an ejection nozzle to direct it towards the point of the flames and discharges a fire extinguishant out of the nozzle towards the flames, achieving thus a reliable detection and effective extinguishment of only such started fire while preventing any erroneous operation due to other infrared ray sources.

6 Claims, 9 Drawing Figures

AUTOMATIC FIRE EXTINGUISHER WITH INFRARED RAY RESPONSIVE TYPE FIRE DETECTOR

TECHNICAL BACKGROUND OF THE INVENTION

This invention relates generally to automatic fire extinguishers and, more specifically, to an improved automatic fire extinguisher having means for receiving and detecting infrared rays emitted from a started fire , and automatically directing a fire extinguishant ejecting nozzle towards the point of the started fire to extinguish it.

The automatic fire extinguishers of the type referred to include a fire detector and a fire extinguishant ejector mounted to a ceiling wall or the like of a room in a building so that, when the fire detector detects a fire started, a fire extinguishant tank is opened to disperse within the room a fire extinguishant out of a nozzle of the ejector to effectively extinguish the fire.

DISCLOSURE OF PRIOR ART

A typical example of conventional automatic fire extinguishers is so-called sprinkler system operatively associated with either or both of a smoke sensor and a heat sensor, in which a plurality of sprinklers are installed at many positions so that, as soon as the smoke or heat sensor generates a detection signal, the sprinklers will disperse a large amount of fire extinguishing liquid in all directions in the room to perform the fire extinguishment. However, this system has been defective in that, in addition to a wide area watering often unnecessary, the system requires installations of many sprinklers, corresponding complicated mounting of extinguishant supply pipes and actuators, resulting in high installation costs and yet unfavourable appearance.

In order to remove the above defects, the present inventor has already proposed in Japanese Pat. No. 1,035,605 an automatic fire extinguisher which comprises an infrared ray responsive type fire detector including a plurality of light receiving elements and an assembly of an infrared-ray-passing filter and condenser lens for receiving at one of the light receiving elements infrared rays from flames of a started fire depending on the position of fire started, means coupled to a fire extinguishant tank and movable along X and Y axes for directing an ejection nozzle towards the started fire position and ejecting fire extinguishant with the tank opened, and means responsive to an output of the fire detector for opening the tank.

Upon starting of fire, therefore, infrared rays passed through the filter will be incident on one of the light receiving elements through the condenser lens so that a signal indicative of the started fire position will be applied to the means for directing the ejection nozzle towards the started fire position and to the means for opening the tank, whereby the nozzle is controlled to be directed towards the fire position and the tank is opened to carry out an automatic fire extinguishing operation. The extinguisher of this Japanese Patent is advantageous in that the extinguishment can be realized with a single extinguishant ejecting device which thus simplifies the arrangement and remarkably reduces the installation cost, but is defective in that the extinguisher unfavourably responds to infrared rays emitted from such other source than the started fire to be detected as, for example, sunlight, electric light, or various heat sources, so as to result in an erroneous extinguishing operation.

TECHNICAL FIELD OF THE INVENTION

A primary object of the present invention is, therefore, to provide an automatic fire extinguisher maintaining a simple and inexpensive structure and yet capable of discriminating not only the infrared rays of fire flames from those of other infrared ray sources than the fire flames but also variations in the fire flames, so that any erroneous operation can be prevented and the reliability can be remarkably improved.

According to the present invention, this object can be realized by providing an automatic fire extinguisher in which a fire detector is provided to receive infrared rays at one of a plurality of light receiving elements which corresponds to an incident angle of the rays into an assembly of an infrared-ray-passing filter and a condenser lens, an extinguishant ejecting nozzle is controlled by detection output of the fire detector to be directed towards the started fire flames so that, when the output of the fire detector is higher than a predetermined level, an extinguishant tank communicating with the nozzle is opened to discharge towards the flames the extinguishant from the tank through the nozzle, wherein means for processing detection output signals from the fire detector is provided with means for further discriminating variations in the size of the fire flames present in the form of their inherent flaring.

Other objects and advantages of the present invention shall become clear from the following description of the invention detailed with reference to a preferred embodiment illustrated in accompanying drawings.

Figure 1:
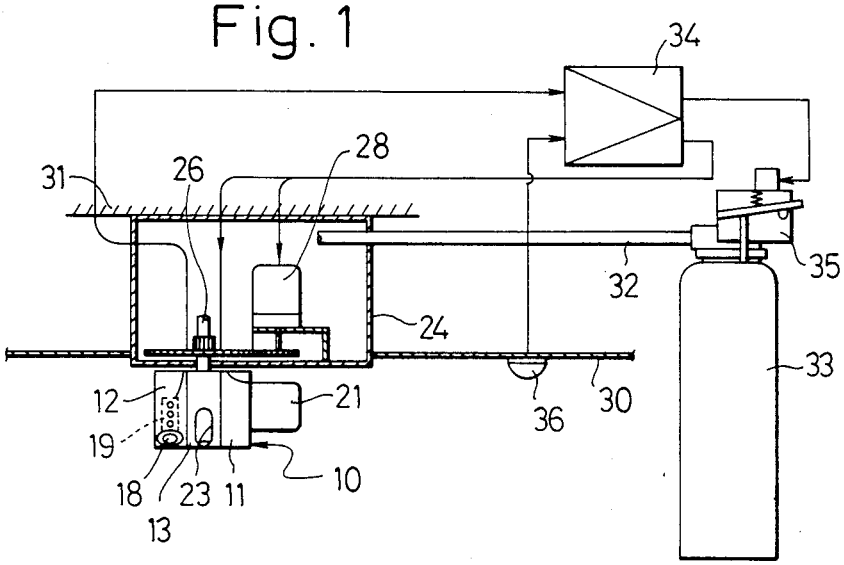
FIG. 1 is a schematic view showing an automatic fire extinguisher according to the present invention, which including an infrared ray responsive type fire detector.

While the present invention shall now be described with reference to the preferred embodiment shown in the drawings, it should be understood that the intention is not to limit the invention only to the particular embodiment shown but rather to cover all alterations, modifications and equivalent arrangements possible within the scope of appended claims.

DISCLOSURE OF PREFERRED EMBODIMENT

Figure 2:
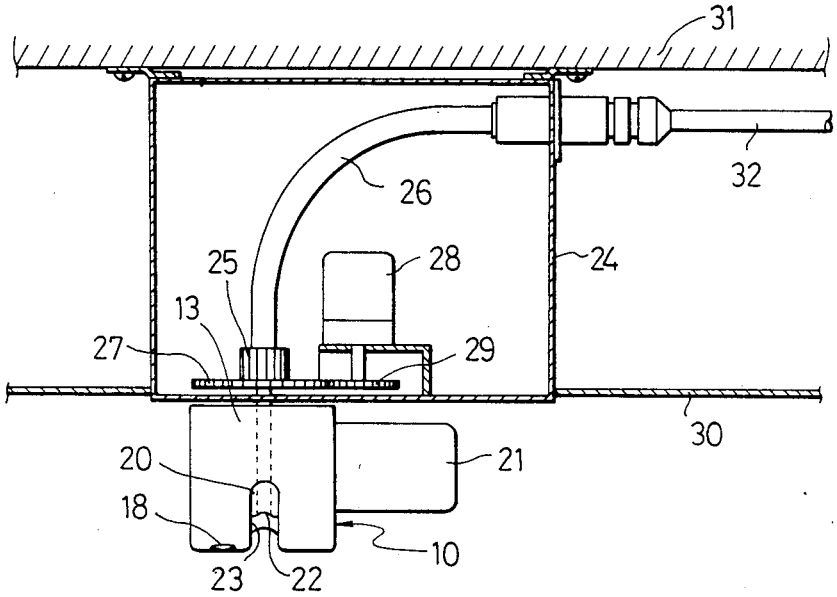
FIG. 2 is a side elevation as magnified of a part of the extinguisher of FIG. 1.
Figure 3:
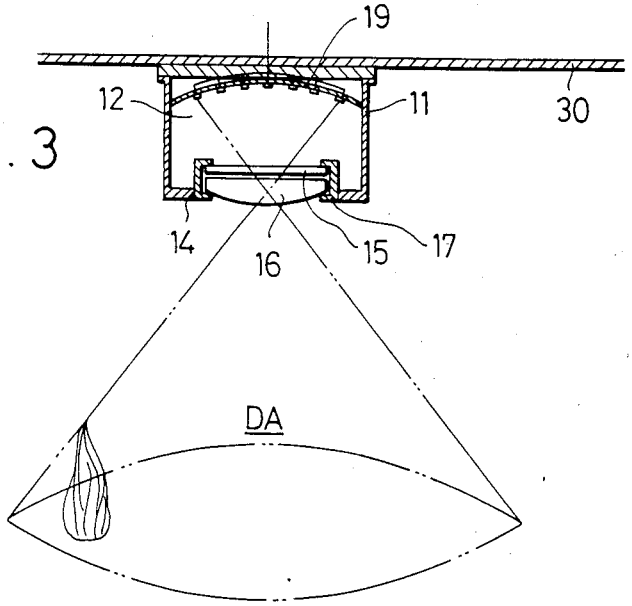
FIG. 3 is an explanatory view for a detecting area obtained by means of the fire detector in the fire extinguisher of FIG. 1.

Referring to FIGS. 1 to 3, the automatic fire extinguisher according to the present invention includes a detection/ejection unit 10, a single housing 11 of which contains a fire detector 12 and a fire extinguishant ejecting nozzle 13 which are arranged horizontally side by side. The fire detector 12 is provided at its bottom with an opening 14 in which mounted is an assembly 18 of an infrared-ray-passing filter 15, a condenser lens 16 and a frame 17 circumferentially supporting the filter and lens. Also fixedly provided within the fire detector 12 is a light receiving array 19 which comprises a plurality of light receiving elements arranged in a row so that infrared rays incident to the condenser lens 16 will hit one of the elements through the filter 15 according to the incident angle of the condensed infrared rays. With such arrangement, a detecting area DA will be determined by a positional relationship between the condenser 16 and light receiving array 19, as well as the detection capability of the light receiving elements in the array 19.

The ejecting nozzle 13 in the unit 10 comprises a columnar nozzle body 20 which is held axially rotatably within the housing 11 as coupled to an output shaft of a nozzle driving motor 21 fixed to one side of the housing 11, so that the body 20 can rotate over an angular range of at least 90 degrees and stop at any desired angular position in the range, and an opening 22 of a diametral hole formed in the nozzle body 20 can shift within a recess 23 which is provided in the housing 11 to open from its bottom surface to one side surface over an angular range of more than 90 degrees in response to the rotation of the nozzle body 20 as driven by the motor 21.

The detection/ejection unit 10, on the other hand, is mounted to the bottom surface of a body casing 24 of the automatic fire extinguisher through an axially rotatable joint 25 located within the casing 24 so that the unit 10 will be rotatable with the joint, while this joint 25 is coupled to a fire extinguishant supply duct 26 which is extended at its upper end outwardly from the casing 24 and coupled at the other lower end (not shown) liquid tightly to the nozzle body 20 for supplying thereto the extinguishant. Inside the casing 24, a gear wheel 27 is axially secured to the lower end of the duct 26 or the joint 25 through, if required, a proper reinforcing member, and the gear wheel 27 is meshed with a pinion 29 mounted on an output shaft of a unit driving motor 28 provided within the casing 24. With such arrangement, the rotation of the motor 28 will cause the unit 10 to be rotated 360 degrees through the pinion 29 and gear wheel 27 about an axis perpendicular to the rotary axis of the nozzle driving motor 21. Preferably, the body casing 24 per se is embedded inside a ceiling liner 30 so as to expose the bottom surface of the casing 24 or only the lower end of the duct 26 projecting out of the joint 25 to be accessible from lower side of the ceiling liner, while the casing 24 is fixed at the top surface to an upper partition wall 31 of a building by means of bolts.

The supply duct 26 is coupled at the upper end extended out of the casing 24 to an end of an extinguishant supply pipe 32 which is coupled at the other end to an outlet of an extinguishant tank 33. This tank 33 is provided to be opened by an actuator 35 actuated by an output signal of a signal processing means 34 described later. Upon opening of the tank 33 by the actuator 35, therefore, the fire extinguishant stored in the tank 33 under a proper pressure is urged to be sent to the nozzle body 20 through the supply pipe 32 and duct 26 to be ejected out of the opening 22. The fire extinguishant contained in the tank 33 may be of either liquid or powdery type, and the term "fire extinguishant" herein used also includes pressurized water. It is desirable in this embodiment to accommodate the tank 33 inside the room, with the supply pipe 32 extended from the tank through a side wall to the upper partition wall of the room and coupled to the duct 26. It will be appreciated that, when the unit 10 provides the detection area DA which covers substantially the entire space in the room, only a single supply pipe 32 may be required so as to simplify its mounting in contrast to the case of conventional sprinkler system.

In FIG. 1, the signal processing means 34 is shown to be outside the body casing 24, but it may be placed inside the casing 24 to receive a detection signal from the light receiving array 19 of the fire detector 12 as well as a detection output of a smoke sensitive device 36 secured to the ceiling liner 30 at a proper position, the latter output of the sensitive device 36 being sent to the processing means 34 prior to the former output of the detector 12. The signal processing means 34 provides outputs to the actuator 35, nozzle driving motor 21 and unit driving motor 28, so that the motors 21 and 28 will controllably rotate the nozzle body 20 and detection/ejection unit 10 about their separate axes to their relative positions achieving a desired directive fire extinguishment.

Figure 5A:
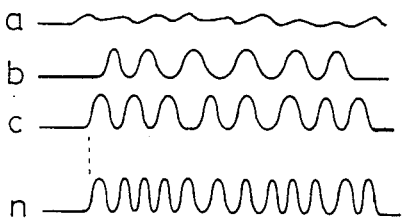
FIG. 5A shows waveforms of output signals appearing at respective light receiving elements arranged in an array, and being provided to the signal processing means of FIG. 4.
Figure 5B:
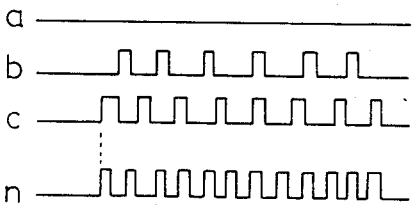
FIG. 5B shows waveforms of output signals of wave shaping circuits in the signal processing means of FIG. 4.
Figure 4:
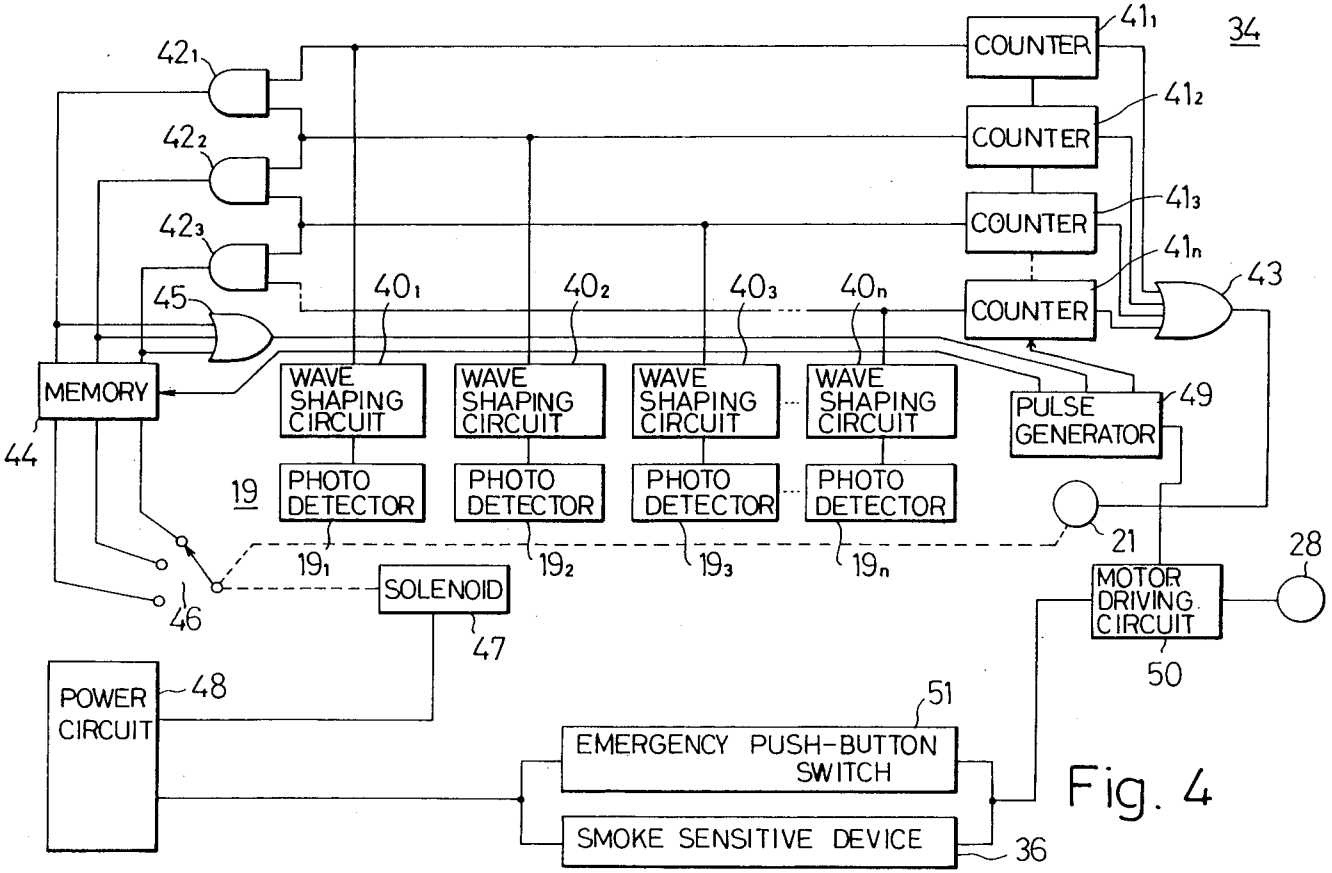
FIG. 4 is a block diagram of an embodiment of means for processing detected output signals of the fire detector in the extinguisher of FIG. 1.
Figure 6A:
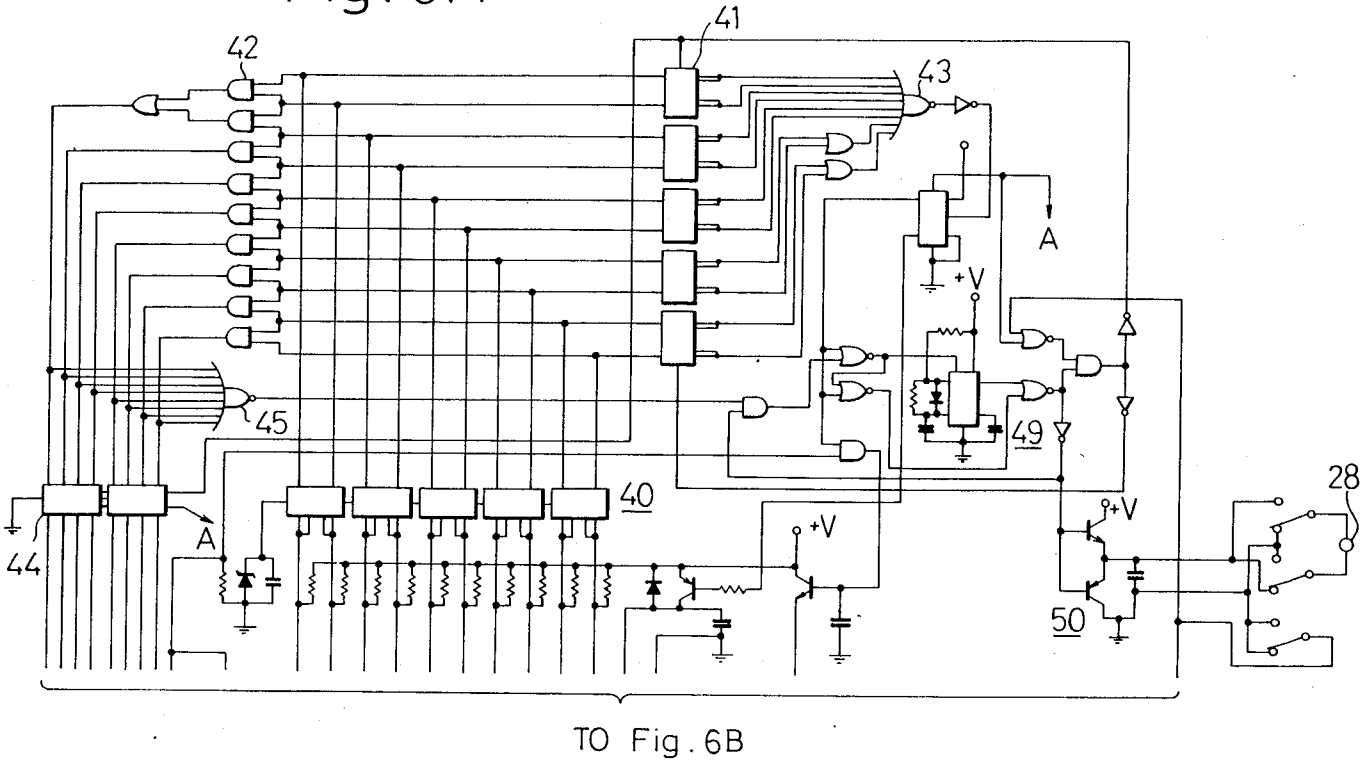
FIGS. 6*a*–6*c* show a detailed circuit diagram of the circuit of FIG. 4.
Figures 6B, 6C:
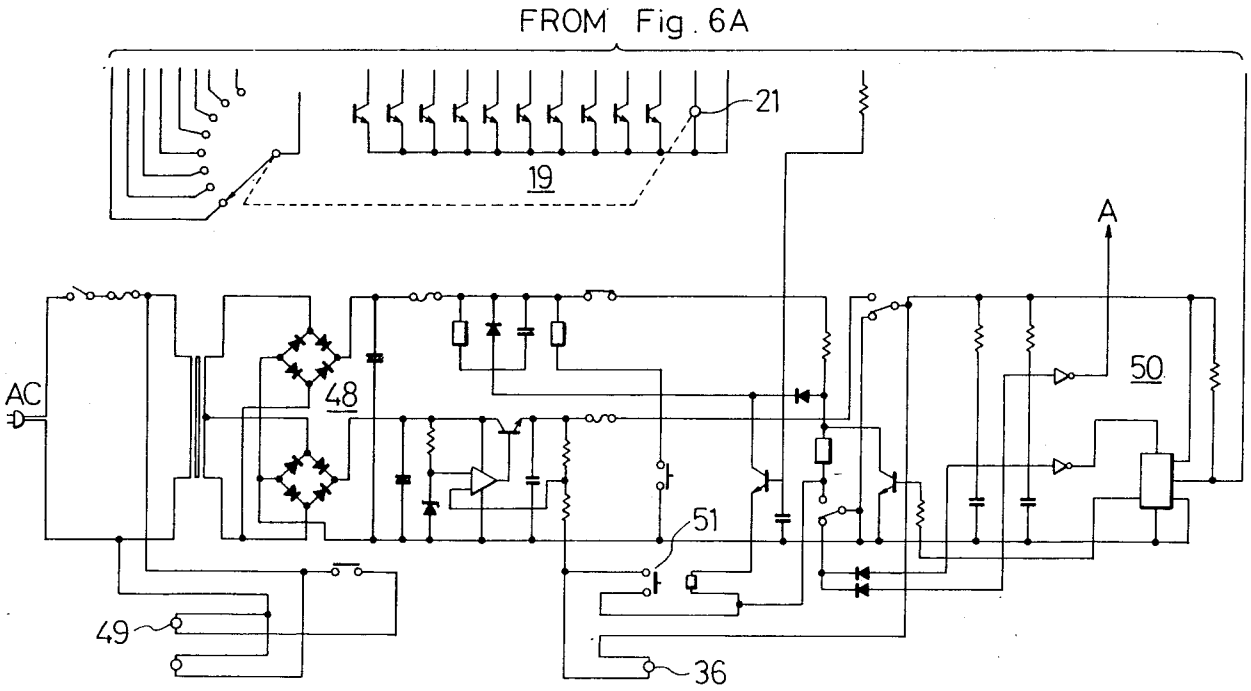

The arrangement of the signal processing means 34 shall now be explained with reference to FIGS. 4 to 6. The processing means 34 includes waveform shaping circuits $\mathbf{40}_1$ to $\mathbf{40}_n$ which respectively process detection outputs of photo detectors $\mathbf{19}_1$ to $\mathbf{19}_n$ forming the light receiving elements of the light receiving array 19. The waveform shaping circuits 40 respectively function to provide an output of a rectangular pulse when the detection output of the photo detector is higher than a predetermined level. Because the fire flames inherently flare so that the respective photo detectors in the array 19 will receive the infrared rays of varying intensity, in other words, the light amount received at each photo detector is variable. When the amount of infrared rays incident to the photo detector is, for example, very low as shown in FIG. 5A(a), however, the corresponding wave shaping circuit 40 provides no output as shown in FIG. 5B(a), so that such flames which emit infrared rays but are small in size as those of a stove or the like will not be detected, because the amount of their infrared rays as received at the photo detector is small.

The pulse output of the respective wave shaping circuits $\mathbf{40}_1$ to $\mathbf{40}_n$ are supplied to corresponding one of counters $\mathbf{41}_1$ to $\mathbf{41}_n$, and a pair of the outputs of respective adjacent two of the shaping circuits $\mathbf{40}_1$ to $\mathbf{40}_n$ are provided to each of AND circuits $\mathbf{42}_1$ to $\mathbf{42}_{n-1}$ as their two inputs as will be later described. When the pulse number of the output from any one of the wave shaping circuits has reached a set value, corresponding one of the counters $\mathbf{41}_1$ to $\mathbf{41}_n$ will send an output to a first OR circuit 43 to energize the nozzle driving motor 21. An output of any one of the AND circuits $\mathbf{42}_1$ to $\mathbf{42}_{n-1}$ is provided to a memory 44 and to a second OR circuit 45. That is, the memory 44 holds therein the output of any one of the AND circuits $\mathbf{42}_1$ to $\mathbf{42}_{n-1}$ as a signal represented by the two adjacent photo detectors and indicative of the started fire position, and sends an output to a contact unit 46 which has contacts corresponding in number to the AND circuits. A movable contact member of the contact unit 46 is provided on the peripheral surface of the nozzle body 20 rotated by the motor 21 so that, when the movable member comes into contact with one of the fixed contacts corresponding to the particular one of the AND circuits which has provided the output, the memory 44 will send the output signal to the motor 21 to stop it, upon which the memory also sends the output signal to a solenoid 47 contained in the actuator 35 of the fire extinguishant tank 33, whereby the solenoid 47 is energized with an output of a power supply circuit 48.

The second OR circuit 45 which receives the outputs of the AND circuits $42_1$ to $42_{n-1}$ sends an output to a pulse generator 49 one of which outputs is applied to the counters $41_1$ to $41_n$ to determine the set value, i.e., a counting time of the respective counters. This enables the output pulse number of the wave shaping circuits to be counted during the set time of the counters, whereas an incident of such a high level of infrared rays as a reflected sunlight to any one of the photo detectors does not cause the wave shaping circuits $40_1$ to $40_n$ to provide no output. In other words, the output of the wave shaping circuits will be at least of an extremely large wave width so as to be not countable at the counters and thus the counter produce no output, whereby any other infrared ray source than the started fire can be omitted from the detecting object of the fire detector.

The pulse generator 49 sends a pulse output to the memory 44 to clear it, and another output to a motor driving circuit 50 to stop the unit driving motor 28 upon receipt of the output from the AND circuit. The motor driving circuit 50 is arranged, on the other hand, to energize the motor 28 in response to a detection output provided from the smoke sensor 36, or responsive to an output from an emergency pushbutton switch 51 which is manually actuated by a person who has found the started fire so as to be operated even prior to the detection by the sensor 36.

The operation of the automatic fire extinguisher according to the present invention shall be explained briefly. If a fire starts in the detection area DA shown in FIG. 3, the sensor 36 will detect it and send an output to the motor driving circuit 50 for energizing the unit driving motor 28. When the detection/ejection unit 10 is thereby rotated to have the fire detector 12 directed towards the started fire position or, in other words, when the fire detector 12 is rotated to a position at which the infrared rays from the started fire flames are incident on the array 19 of the photo detectors, it is discriminated by the wave shaping circuits $40_1$ to $40_n$ and counters $41_1$ to $41_n$ that the detection output from the photo detectors is not of such infrared rays which are constant in the level as those emitted from the small flames of the stove, sunlight or the like. Then the outputs of the counters are sent to the OR circuit 43 to supply the drive signal to the nozzle driving motor 21 for rotating the nozzle body 20.

As the flames of the started fire become relatively larger, the output waves detected at the photo detectors will gradually increase the frequency as seen in FIG. 5A(b) to (n), the output pulse number of the wave shaping circuits will also increase and, at the same time, the infrared red rays will develop to be incident on adjacent two of the photo detectors in the light receiving array 19, one of the AND circuits corresponding to these two photo detectors is caused to generate the output, which is sent through the second OR circuit 45 to the pulse generator 49 so that, responsive to the output of the pulse generator 49, the motor driving circuit 50 will stop the unit driving motor 28, the fire detector 12 will be here positioned to direct the recess 23 including the ejection nozzle 13 towards the started fire position.

The output of the AND circuit is also applied to the memory 44 as a signal indicative of the started fire position so that the nozzle body 20 is rotated in response to this signal and, when the movable contact of the contact unit 46 comes into contact with one of the fixed contacts which corresponds to the particular AND circuit, the nozzle body 20 will be stopped at the angular position where the nozzle opening 22 is directed towards the started fire position. The solenoid 47 of the actuator 35 for the fire extinguishant tank 33 is energized at this time, and the extinguishant is ejected from the nozzle opening 22 towards the fire flames for extinguishing them.

In this embodiment, the entire detection/ejection unit 10 can rotate over the range of 360 degrees about the vertical X axis which is substantially the rotary axis of the unit driving motor 28 and, even when the rotation range of the fire detector 12 is set to be substantially identical to that of the nozzle opening 22, the detector 12 can detect any fire started at any position in the detection area DA. Further, the nozzle body 20 can rotate over the range of at least 90 degrees about the horizontal Y axis which is the rotatary axis of the nozzle driving motor 21. As a result, the nozzle opening 22 is subjected to a universal directivity control along the X and Y axes for discharging the extinguishant towards any position in the detection area DA.

According to the automatic fire extinguisher of the present invention, the intended object can be realized and, in addition, the fire detector 12 is made to be capable of detecting even a flame slightly larger than that of the stove or the like, that is, the present invention makes it possible to detect the fire started at the early stage and, when the smoke sensor is set to be sufficiently high in the sensitivity, also to extinguish the fire effectively as quick as possible, in contrast to the case of conventional sprinkler system utilizing a smoke or heat sensor in which the sufficiently high sensitivity of the sensor may easily cause erroneous operation of the system due to smoke of cigarettes, raised room temperature and so on while failing to perform the early stage fire detection and extinguishment. In the present invention, however, the increase in the sensitivity of the sensor will cause only a prompt rotation of the detection/ejection unit 10 through the unit driving motor 28 but the fire detector does not operate until it detects the fire flames emitting the infrared rays beyond the predetermined level so that the erroneous operation can be effectively prevented.

The present invention may be modified in various ways. For example, instead of such detection range of the light receiving array 19 of the fire detector 12 as well as the operational range of the nozzle body 20 of the ejection nozzle 13 and thus of the nozzle opening 22 that has been referred to as being substantially 90 degrees, these ranges may be set respectively to be 180 degrees, in which event the operational range of the unit 10 may be set to be substantially 180 degrees. Further, while the light receiving elements of the array 19 in the fire detector 12 have been disclosed as arranged in a row, they may arranged in a plurality of rows as staggered. The smoke sensor 36 may be replaced by a heat sensor or the one sensitive to both the smoke and heat may be used. It is also possible to replace the smoke sensor 36 by an additional infrared ray detector comprising the same filter-lens assembly as that of the fire detector 12 and a plurality of the light receiving elements arranged over the entire area inside the detector. Further, the detection/ejection unit 10 may be provided to be rotated at all times so that the other sensor may be made unnecessary, in which event the detection range of the light receiving array 19 should preferably be of 180 degrees.

What is claimed as my invention is:

1. An automatic fire extinguisher comprising a fire detector including a plurality of light receiving elements and an assembly of an infrared-ray-passing filter and a condenser lens for receiving infrared rays at one end of said light receiving elements which corresponds to an incident angle of said infrared rays, a fire extinguisher tank, an ejection nozzle means communicating with said tank, a signal processing means responsive to a detected position output of said fire detector for discriminating variations in the intensity of the output due to the fire of flames of a started fire, means responsive to a first output of said signal processing means for directing said ejection nozzle means towards a position of the started fire, means responsive to a second output of said signal processing means for opening said tank, means connected to said light receiving elements for generating a rectangular pulse as the first output when the detected position output exceeds a predetermined level, and means connected to said pulse generating means for counting the number of pulses provided during a predetermined time period and providing the second output when the counted pulse number has reached a predetermined value, said light receiving elements of said fire detector being arranged in a row to form a light receiving array, said pulse generating means of said signal processing means comprising a plurality of wave shaping circuits respectively connected to each of said light receiving elements, said counting means of said signal processing means comprising a plurality of counters respectively connected to each of said wave shaping circuits, and said signal processing means further comprising a plurality of AND circuits respectively receiving outputs from two of said wave shaping circuits corresponding to adjacent two of the light receiving elements, and a pulse generator receiving outputs of said AND circuits and generating an output to set the predetermined counting time period.

2. An extinguisher according to claim 1 wherein said ejection nozzle means comprises a casing rotatable about a vertical axis and a nozzle member housed in said casing to be rotatable about a horizontal axis, and said directing means comprising a first motor driving said nozzle member about said horizontal axis and a second motor driving said casing about said vertical axis as energized by a predetermined input, said first and second motors being stopped by outputs of said AND circuits.

3. An extinguisher according to claim 2 wherein said predetermined input energizing said second motor is an output from a smoke sensor.

4. An extinguisher according to claim 3 wherein said output of said smoke sensor is applied through a motor driving circuit to said second motor, and said outputs of said AND circuits are applied through said pulse generator and motor driving circuit to the second motor.

5. An extinguisher according to claim 2 wherein said output of said AND circuits for stopping said first motor is applied thereto through a memory and a contact unit which opens and closes contacts thereof in response to said rotation of said nozzle member.

6. An extinguisher according to claim 5 wherein said tank opening means includes a solenoid operatively associated with said contact unit to be energized when said output of said AND circuits is applied to said first motor through said contact unit.

* * * * *